US005361892A

United States Patent [19]

Hamaker et al.

[11] Patent Number: 5,361,892

[45] Date of Patent: Nov. 8, 1994

[54] EXTENDED LIFE GRATE BAR

[75] Inventors: Eugene D. Hamaker, Marshall; David C. Reschly, Monroe, both of Mich.

[73] Assignee: Detroit Stoker Company, Monroe, Mich.

[21] Appl. No.: 132,204

[22] Filed: Oct. 6, 1993

Related U.S. Application Data

[62] Division of Ser. No. 901,905, Jun. 22, 1992, Pat. No. 5,265,543.

[51] Int. Cl.[5] ..... B65G 17/30

[52] U.S. Cl. ..... 198/841; 198/837

[58] Field of Search ..... 198/837, 841; 110/268, 110/269

[56] References Cited

U.S. PATENT DOCUMENTS

| | | | |
|---|---|---|---|
| 755,662 | 3/1904 | Hill . | |
| 1,160,360 | 11/1915 | Atterbury . | |
| 1,243,186 | 10/1917 | Kohout . | |
| 1,738,379 | 12/1929 | Lower . | |
| 2,702,726 | 2/1955 | Frendberg . | |
| 2,794,406 | 6/1957 | Stark . | |
| 2,806,439 | 9/1957 | Wagner . | |
| 2,983,234 | 5/1961 | Reilly . | |
| 3,023,716 | 3/1962 | Reisman . | |
| 3,063,696 | 11/1962 | Culling . | |
| 3,126,846 | 3/1964 | Wagner . | |
| 3,482,534 | 12/1969 | Whitman . | |
| 3,861,659 | 1/1975 | Evenstad | 110/269 X |
| 3,980,425 | 9/1976 | Pinettes et al. . | |
| 4,434,724 | 3/1984 | Kunkel, Jr. . | |
| 4,475,468 | 10/1984 | Ishikawa et al. . | |
| 4,528,917 | 7/1985 | Jacobs . | |
| 4,532,872 | 8/1985 | Anderson . | |
| 4,602,572 | 7/1986 | Giaier et al. . | |
| 4,616,573 | 10/1986 | Giaier et al. . | |
| 4,718,360 | 1/1988 | Giaier et al. . | |
| 4,876,972 | 10/1989 | Mrklas . | |
| 4,905,613 | 3/1990 | Reschly et al. . | |
| 5,265,543 | 11/1993 | Hamaker et al. | 110/269 |

FOREIGN PATENT DOCUMENTS

| | | | |
|---|---|---|---|
| 0243731 | 11/1987 | European Pat. Off. | 198/841 |
| 0294913 | 10/1991 | Netherlands | 198/841 |
| 1399228 | 5/1988 | U.S.S.R. | 198/841 |
| 1426896 | 9/1988 | U.S.S.R. | 198/841 |

*Primary Examiner*—James R. Bidwell

*Attorney, Agent, or Firm*—Harness, Dickey & Pierce

[57] ABSTRACT

An improved, long-life grate bar for use in the traveling grate bar mechanism of a solid-fuel-burning furnace apparatus and having hard wear pad inserts which are disposed within the end portions of the grate bar which ride along support rails. The wear pad inserts can be fabricated from a hard nickel-steel alloy material and can be integrally formed in the grate bar.

3 Claims, 2 Drawing Sheets

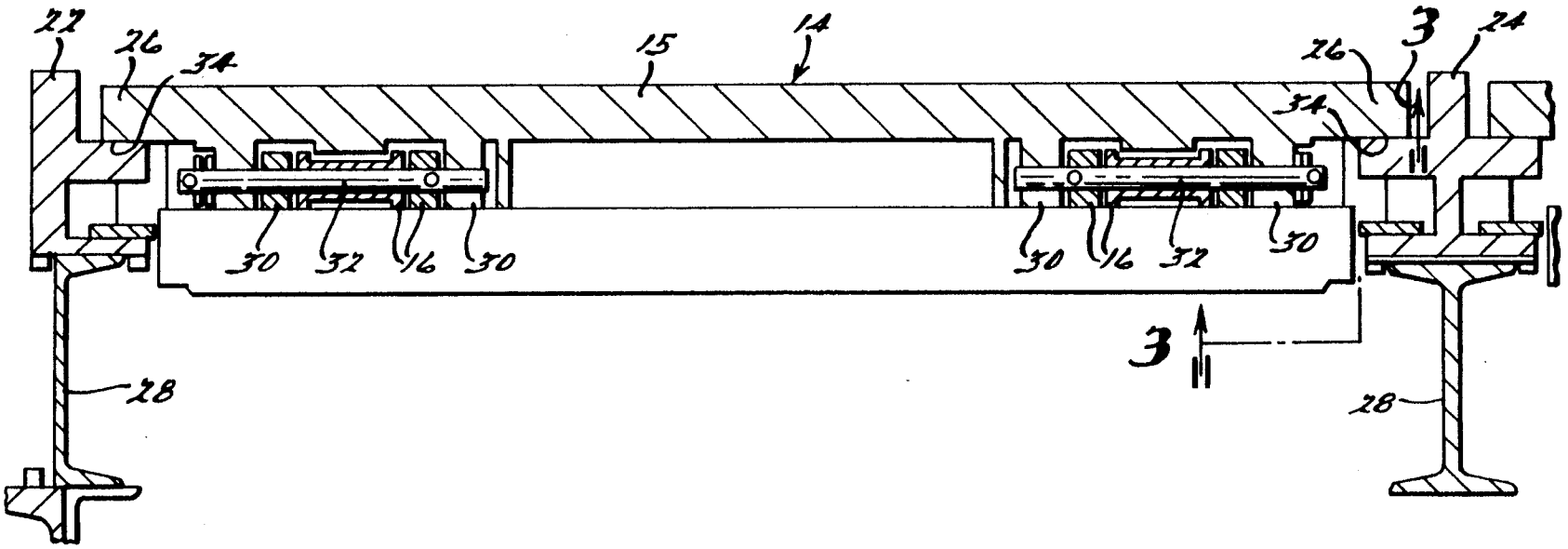
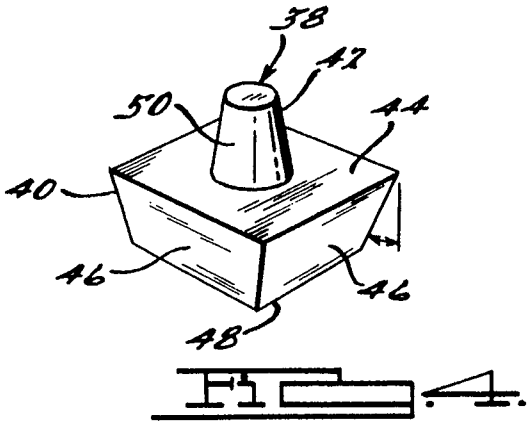
FIG. 4.
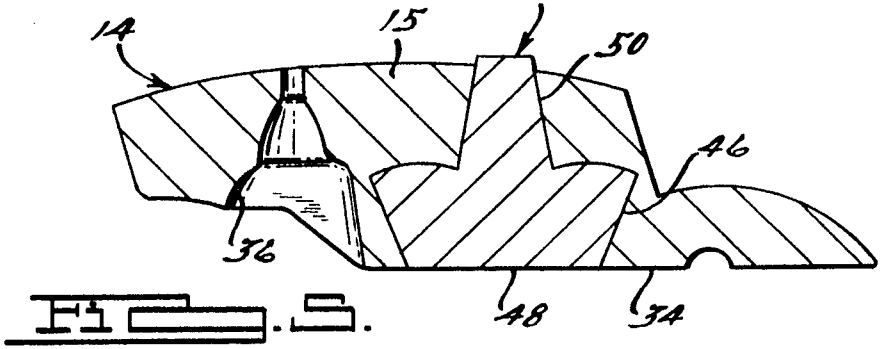
FIG. 2.
FIG. 5.

EXTENDED LIFE GRATE BAR

This is a division of U.S. patent application Ser. No. 07/901,905, filed Jun. 22, 1992, Now U.S. Pat. No. 5,265,543.

BACKGROUND AND SUMMARY OF THE INVENTION

The present invention relates generally to a grate bar for use in a solid fuel burning furnace apparatus having a traveling grate bar mechanism, and more particularly to an improved grate bar having unique, localized hard wear surfaces for eliminating premature wear and extending the useful life of the grate bar.

Grate bars for use in a solid-fuel-burning furnace apparatus having a traveling grate bar mechanism are designed to operate in a very severe environment. For example, the grate bars must be capable of withstanding the extremely elevated temperatures found in the combustion chamber of the furnace apparatus. At the same time, the grate bars must be able to resist significant shock loads, such as the shock resulting from objects falling onto the grate bars from high up in the furnace, like slag or metallic and concrete items that can be included with refuse fuels. Thus, grate bars must be designed not only to be heat resistant but also to be tough and ductile. Consequently, grate bars are typically cast from materials such as ductile iron, cast iron or stainless steel, they have a hardness value on the order of about 220 Brinell and they are costly components of the traveling grate bar mechanism.

However, in certain solid-fuel-burning furnace apparatus, such as those that burn RDF or other refuse fuels, the grate bars of the traveling grate bar mechanism have been known to experience excessive wear which reduces their expected operating life and makes it necessary to replace them prematurely and at a significant cost. It has been discovered that often times a portion of the fuel fed into the furnace apparatus consists of non-combustible materials which are very abrasive in nature and are harder than the grate bars. This non-combustible material has been known to eventually become lodged in the traveling grate bar mechanism between the grate bars and the harder support rails along which the grate bars travel. Consequently, the harder, abrasive, non-combustible material causes the softer and more ductile grate bars to wear prematurely.

In addition, the potential for such an excessive wear problem could exist in a coal-fuel-burning furnace apparatus where there are high percentages of ash and the grate bars travel too rapidly through the combustion chamber of the furnace. Situations such as the one Just described could be present in the coal-fuel-burning furnace applications in foreign countries as well as when lower grade coal supplies are used as fuel in the United States.

It is believed that increasing the hardness of the portions of the grate bars that travel along the support rails would alleviate the excessive wear described above and, thus, would eliminate the costs associated with prematurely replacing the grate bars. However, attempts to accomplish this objective by the method of heat treatment are considered impractical. One reason for this conclusion is that the ductile, heat resistant materials from which the grate bars are formed are not well-suited for heat treatment. This is especially true of stainless steels. Another reason is that any increase in the hardness of the grate bars achieved by the method of heat treatment could be lost in the high-temperature operating environment of the furnace apparatus. Still a third reason is that an attempt to increase the hardness of the grate bar by the method of heat treatment could cause a corresponding decrease in the ductility of the grate bar and, consequently, could cause the grate bar to be unacceptably brittle.

The extended life grate bar for use in a solid fuel burning furnace apparatus having a traveling grate bar mechanism of the present invention, however, achieves the result of increasing the hardness of the grate bar while, at the same time, overcoming the practical limitations of heat treatment. The present invention is a grate bar having hard wear pad inserts that are integrally disposed within the grate bar. The wear pad inserts can be fabricated from any suitable extra hard high-wear material, such as a hard nickel-steel alloy material, for example, the material well-known by the tradename "Ni-Hard." Further, it has been discovered that the wear pad inserts can be "cast in" the grate bar at the time the grate bar is formed.

The extended life grate bar of the present invention eliminates the excessive wear known to occur in conventional grate bars. An additional advantage of the present invention is that it increases the reliability of the traveling grate bar mechanism and eliminates expenses associated with the replacement of prematurely worn grate bars, such as lost production time and replacement part costs. A further advantage of the present invention is that it may be easily incorporated into the design of a conventional grate bar, thereby minimizing any costs associated with achieving the advantages of the present invention.

Other advantages and features of the present invention will become apparent to one skilled in the art in light of the following description and claims, taken in conjunction with the accompanying drawings.

BRIEF DESCRIPTION OF THE DRAWINGS

FIG. 2 is a fragmentary transverse cross-sectional view illustrating arm individual grate bar of the forward traveling grate bar mechanism of FIG. 1, looking toward the front of the furnace apparatus;

FIG. 4 is a perspective view showing a wear pad insert for the extended life grate bar of the present invention;

FIG. 5 is a cross-sectional view along section line 5—5 of FIG. 3 illustrating the wear pad insert of FIG. 4 as disposed within the grate bar of FIG. 2.

DETAILED DESCRIPTION OF THE PREFERRED EMBODIMENT

Figure 1:
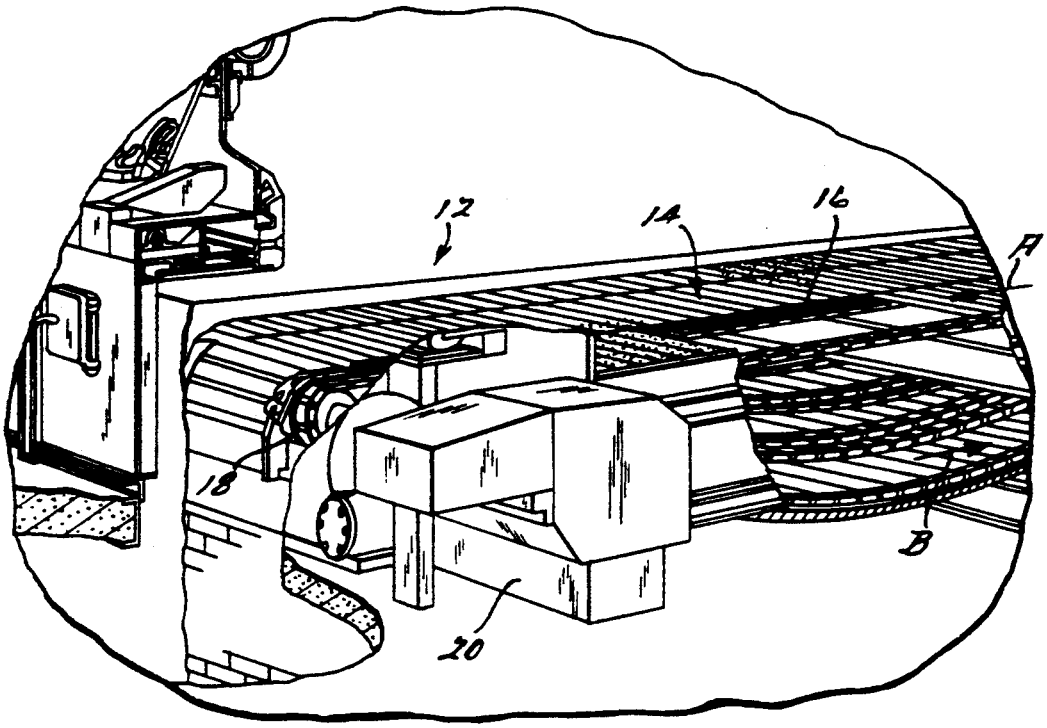
FIG. 1 is a fragmentary perspective view showing a partial section of a continuous ash discharge spreader stoker furnace apparatus having a forward traveling grate bar mechanism.

Referring now to the drawings, and in particular FIG. 1, there is illustrated a continuous ash discharge spreader stoker furnace apparatus having a conventional forward traveling grate bar mechanism 12. The traveling grate bar mechanism 12 has a plurality of grate bars 14 which are arranged into several longitudinal rows (three of which are shown in FIG. 1). Each row of grate bars 14 is conveyed on two endless grate chains 16 and each grate bar 14 is linked at each end to the grate chains 16. The grate chains 16, in turn, ride over toothed sprockets 18 which are driven by a power transmission unit 20. The traveling grate bar mechanism 12 is well-known in the art and operates to carry the grate bars 14 in a continuous loop (as indicated by the direction of arrows A and B) through the combustion chamber of the furnace apparatus at a predetermined rate relative to the fuel and air supplied to the furnace apparatus.

Figure 3:
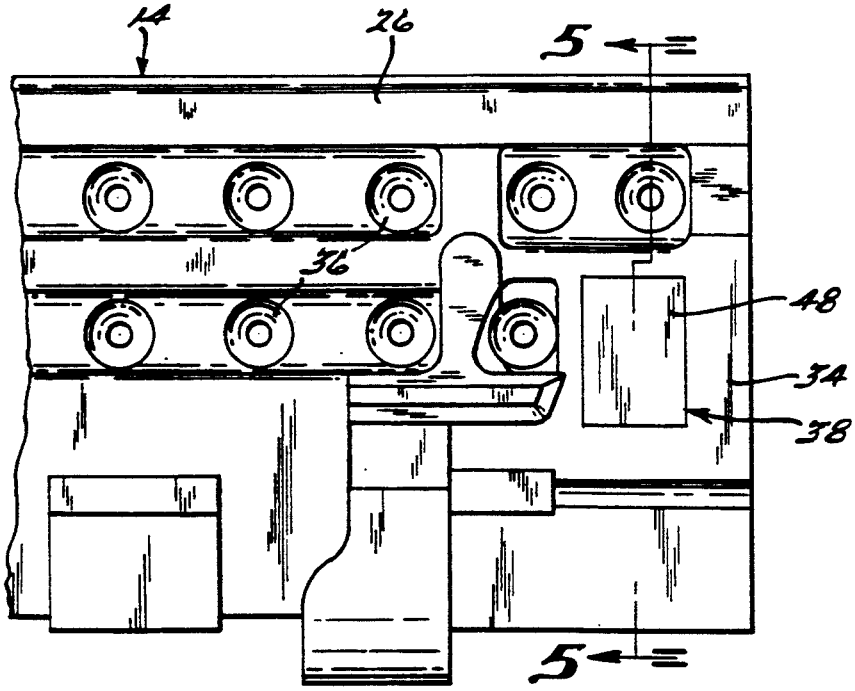
FIG. 3 is a partial bottom plan view taken from line 3—3 of FIG. 2 showing the end portion of the grate bar of FIG. 2.

Turning now to FIGS. 2 and 3, the grate bar 14 is similar in overall configuration to a conventional grate bar and can be generally understood as being a long, transversely extending metal bar member 15, usually ranging from about 36 inches to about 51 inches in length, and having a generally rectangularly-shaped cross-section. The bar member 15 is generally a cast member formed from heat resistant yet tough and ductile materials, such as ductile iron or stainless steel, for example, having a hardness value generally on the order of about 220 Brinell.

In FIG. 2, the grate bar 14 is shown to be disposed on and between a first support rail 22 and a second support rail 24, which support the grate bar 14 at opposite end portions 26 of the bar member 15 when in the operative position. The support rails 22, 24, in turn, are supported by the understructure 28 of the traveling grate bar mechanism 12. The bar member 15 is shown to include spaced mounting lugs 30, located near each end portion 26, at which point the grate chains 16 are connected to the grate bar 14 by link pins 32. The mounting lugs 30 enable the grate chains 16 to advance the grate bar 14 forward along the support rails 22, 24 and through the combustion chamber of the furnace apparatus in the direction indicated by arrow A (as shown in FIG. 1). The return travel of the grate bar 14 causes the grate bar 14 to be carried to the rear of the combustion chamber as indicated by arrow B (also shown in FIG. 1). Therefore, the travel of the grate bar 14 through the combustion chamber is in an continuous loop.

FIG. 3 shows a partial bottom plan view of the end portion 26 of the bar member 15 as seen along line 3—3 of FIG. 2. The bottom surface 34 of the bar member 15 generally indicates the areas on a conventional grate bar which have been known to be subjected to excessive wear due to hard, abrasive, non-combustible material becoming lodged between the grate bar and the support rails 22, 24, as the grate bar is advanced through the combustion chamber of the furnace apparatus along the support rails 22, 24. Nozzles 36 facilitate airflow through the bar member 15 and enhance the combustion characteristics of the furnace apparatus.

In addition, FIG. 3 shows hard wear pad inserts 38 integrally disposed within opposite end portions 26 of the bar member 15. The wear pad insert 38 can be formed from a suitable hard alloy material, such as a nickel-steel alloy well-known by the tradename "Ni-Hard," for example. The wear pad insert has a greater hardness value than the bar member 15, and specifically, a hardness value generally on the order of about 550 Brinell has been learned to be desirable to ensure adequate resistance against excessive wear.

With reference now to FIG. 4, the wear pad insert 38 generally has a trapezoidally-shaped body portion 40 and a conically-shaped stud portion 42 which projects from a surface 44 of the body portion 40. The body portion 40 has drafted side walls 46 which taper outwardly from a planar wear surface 48 (best seen in FIGS. 3 and 5) and the stud portion 42 tapers inwardly along side surface 50 as it projects from the body portion 40.

As best understood in FIGS. 3 and 5, the wear pad insert 38 is disposed within the end portions 26 of the bar member 15 such that the planar wear surface 48 is flush with the surrounding bottom surface 34 of the bar member 15. The planar wear surface 48 is shown to be a generally flat rectangular surface which provides the substantially central area of the bottom surface 34 at the end portion 26 of the bar member 15, as is best shown in FIG. 3. In FIG. 5, the tapered walls 46, 50 of the body 40 and stud 42 portions of the wear pad insert 38 are shown to cause the wear pad insert 38 to be mechanically interlocked and securely fixed within the end portions 26 of the bar member 15 so as to prevent the wear pad insert 38 from becoming dislodged or separated from the bar member 15 while in use.

Under operating conditions, the hard planar wear surfaces 48 of the wear pad inserts 38 act to enhance the wearability of the bottom surface 34 of the bar member 15 at the end portions 26, as the grate bar 14 is carried along the support rails 22, 24. Thus, the wear pad inserts 38 perform the function of providing a hard surface to resist the excessive wear in the end portions 26 of the bar member 15 at locations 34 which has been known to occur in conventional grate bars to the point where it is necessary to prematurely replace the grate bars. Consequently, the grate bars 14 of the prevent invention are not required to be replaced as often as conventional grate bars and, therefore, have an extended operating life.

The extended life grate bar 14 of the present invention can be manufactured generally from the same materials, and generally in the same manner, as a conventional grate bar. For example, the extended life grate bar 14 can be a cast member formed from heat resistant ductile iron, cast iron or stainless steel. The wear pad inserts 38, made of Ni-Hard or another suitable material, can be integrally formed within the bar member 15 as inserts placed in the casting die such that the wear pad inserts 38 are "cast into" the bar member 15.

The improved grate bar 14 of the present invention is expected to achieve the advantage of extending the useful life of the grate bar 14 by alleviating the excessive wear found at the end portions 26 of the grate bar 14 which is common to conventional grate bars of a traveling grate bar mechanism 12 in a solid-fuel-burning furnace apparatus burning RDF or other refuse fuels, or high ash coals. In addition, the present invention is expected to increase the reliability of the traveling grate bar mechanism 12 and eliminate the expenses associated with the replacement of prematurely worn grate bars, such as lost production time and replacement part costs. Further, the present invention may be easily incorporated into the design of a conventional grate bar to thereby minimize the costs associated with producing grate bars 14 according to the teachings of the present invention.

While it is apparent that the embodiment of the present invention described above is well calculated to provide the advantages discussed, it should be appreciated that the present invention is susceptible to modification, variation, and change without departing from the proper and fair meaning of the subjoined claims.

What is claimed is:

1. A one-piece wear pad insert for use in a grate bar of a solid-fuel-burning furnace having a traveling grate bar mechanism to alleviate excessive wear in said grate bar, said wear pad insert having a generally trapezoidally-shaped body portion in vertical cross-section and a , conical-shaped stud portion, said body portion having a lower planar wear surface and drafted side walls, said side walls tapering outwardly from said wear surface.

2. The wear pad insert of claim 1, wherein said wear pad insert is formed from a heat resistant metal having a hardness value of about 550 Brinell or greater.

3. The wear pad insert of claim 2, wherein said wear pad insert is formed from a nickel-steel alloy.

* * * * *

UNITED STATES PATENT AND TRADEMARK OFFICE

CERTIFICATE OF CORRECTION

PATENT NO. : 5,361,892

DATED : November 8, 1994

INVENTOR(S) : Eugene D. Hamaker; David C. Reschly

It is certified that error appears in the above-indentified patent and that said Letters Patent is hereby corrected as shown below:

Column 1, line 5, "Now" should be -- now --.

Column 1, line 53, "Just" should be -- just --.

Column 2, line 46, "arm" should be -- an --.

Column 5, line 3, delete ",".

Signed and Sealed this

Seventh Day of March, 1995

*Attest:*

*Attesting Officer*

BRUCE LEHMAN

*Commissioner of Patents and Trademarks*